US005664936A

United States Patent [19]

Cunha et al.

[11] Patent Number: 5,664,936

[45] Date of Patent: Sep. 9, 1997

[54] FAN MOUNTING ARRANGEMENT

[75] Inventors: Jorge Cunha; Gerson Hélio Fernando Fischer; Ettore Santos Consiglio, all of Joinville, Brazil

[73] Assignee: Multibrás S/A/ Eletrodomésticos, São Paulo, Brazil

[21] Appl. No.: 527,565

[22] Filed: Sep. 13, 1995

[30] Foreign Application Priority Data

Sep. 21, 1994 [BR] Brazil ..... 7401491 U

[51] Int. Cl.[6] ..... F04D 29/36

[52] U.S. Cl. ..... 416/204 R; 416/206

[58] Field of Search ..... 416/204, 206, 416/221, 244 R, 134 R

[56] References Cited

U.S. PATENT DOCUMENTS

| | | | |
|---|---|---|---|
| 2,410,832 | 11/1946 | McLean | 416/206 |
| 3,164,402 | 1/1965 | Jobe | 416/204 R |
| 3,264,016 | 8/1966 | Reisch | 416/134 |
| 3,319,939 | 5/1967 | Rogenski | 416/204 R |
| 4,396,352 | 8/1983 | Pearce | 416/206 |

FOREIGN PATENT DOCUMENTS

| | | | |
|---|---|---|---|
| 3839467 | 5/1990 | Germany | 416/221 |

*Primary Examiner*—Edward K. Look
*Assistant Examiner*—Mark Sgantzos
*Attorney, Agent, or Firm*—Darby & Darby

[57] ABSTRACT

A fan mounting arrangement of the type comprising a blade assembly incorporated to a tubular central hub (1, 10) fitted into a shaft end (2, 20) of a motor (M), the central hub (10) having at least one engaging projection (11) fitted into a corresponding engaging recess (21) provided at an end portion of the shaft end (20), in order to mount the central hub (10) to said shaft end (20) restraining said parts from relative movements, the fitting being obtained by the elastic deformation of part of the lateral wall of said central hub (10).

8 Claims, 2 Drawing Sheets

FAN MOUNTING ARRANGEMENT

FIELD OF THE INVENTION

The present invention refers to a fan mounting arrangement of the type used in refrigerating systems, such as air conditioners, and, more particularly, the present invention refers to the attachment of the tubular hub of said fan to the shaft of the respective drive motor.

BACKGROUND OF THE INVENTION

Refrigerating systems, such as air conditioners, usually comprise two blade assemblies which after being incorporated to a respective tubular central hub are mounted to an ordinary drive motor. Such mounting is usually made by tight fitting the tubular central hub to an adjacent shaft end of the motor.

In a known prior art form to mount said central hub to the motor shaft, the central hub-shaft end assembly, after being mounted, receives a fixing element that will act on both engaged pieces, avoiding relative longitudinal movements therebetween. The relative rotational movement is avoided by the semi-circular shape of both the shaft end and tubular central hub.

In a known form for mounting the fan to the motor shaft (FIG. 1), the retention between said pieces is obtained by providing a metallic band surrounding the tubular central hub after the latter has been mounted to the corresponding motor shaft end. In this construction, the fixation occurs by compressing the tubular central hub against the shaft end.

In another known construction, (FIG. 2), the fan-motor shaft assembly is made by the introduction, into a radial throughbore provided in the tubular central hub, of a screw that acts against the adjacent surface of the motor shaft, restraining the latter from the relative longitudinal movement mentioned above.

Although these constructions allow an adequate fixation of the fan to the motor shaft, said solutions present some disadvantages, such as the need for additional parts and a difficult slow mounting operation that will consequently increase the cost of the product.

DISCLOSURE OF THE INVENTION

Thus, it is an object of the present invention to provide a fan mounting arrangement for refrigerating systems such as air conditioners, to be mounted to a corresponding motor shaft, which does not require additional parts, making the assembly fast and practical, without impairing the desired result.

It is also an object of the present invention to provide a fan mounting arrangement as described above, which allows the automation of the mounting operation by mutually attaching said two pieces, thus reducing the costs of the product.

These and other objectives are attained by a fan mounting arrangement of the type comprising a blade assembly incorporated to a tubular central hub attached to a motor shaft end, said central hub having at least one engaging projection to be fitted into a corresponding engaging recess provided at an end portion of the shaft end, in order to attach the central hub to said shaft end, restraining these parts from relative movements, the fitting being obtained by the elastic deformation of part of the lateral wall of said central hub.

BRIEF DESCRIPTION OF THE DRAWINGS

The invention will be described below, with reference to the attached drawings, in which.

BEST MODE FOR CARRYING OUT THE INVENTION

Figure 2:
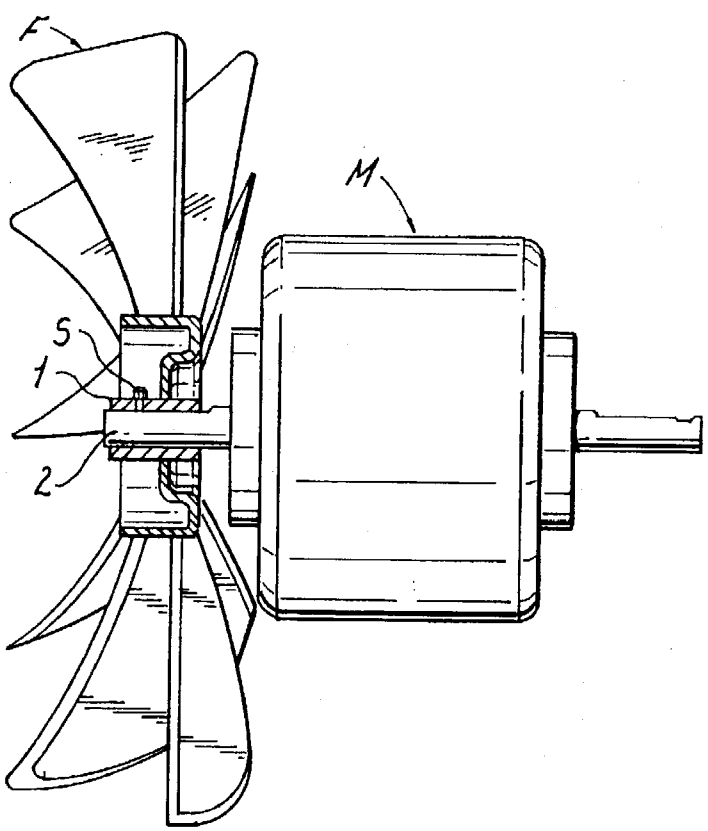
Fig. 2 (Prior Art)
FIG. 2 shows a schematic longitudinal section view of a fan mounted to the shaft of a motor, according to another assembly form of the prior art.
Figure 1:
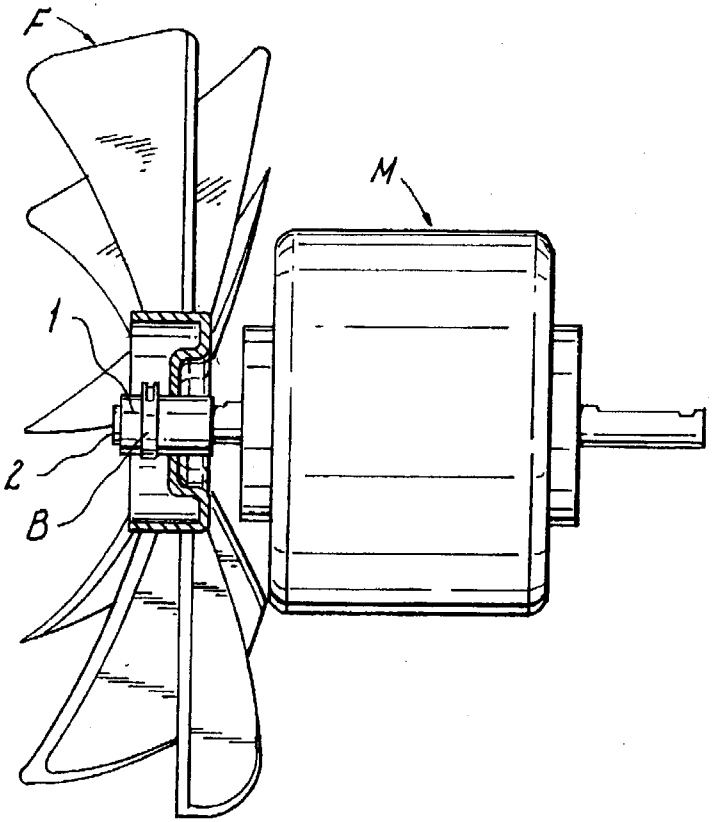
Fig. 1 (Prior Art)
FIG. 1 shows a schematic longitudinal section view of a fan mounted to the shaft of a motor, according to a prior art assembly form.

According to FIGS. 1 and 2, there is illustrated a fan F of the type comprising a blade assembly incorporated to a tubular central hub 1, which is fixedly mounted to an adjacent shaft end 2 of a motor M, in such a way as to avoid axial movements in relation to said drive shaft 1. The fitting in the prior art is obtained by the pressure applied against said drive shaft.

To avoid the relative rotational movement between the central hub 1 and the adjacent shaft end 2, said pieces have similar semi-circular shapes. This shape is obtained by an axially beveled region defined in their respective surfaces.

In a prior art construction, for the attachment of the central hub to the shaft end, after fitting the tubular central hub 1 to the adjacent shaft end 2, a screw S is placed into a radial throughbore 1*a* provided at a free end portion of the tubular central hub 1, in order to apply over an adjacent surface portion of the shaft end 2 a compressive force against said surface, avoiding relative axial movements between the parts being mounted.

In another prior art construction, the central hub-shaft end assembly occurs by the introduction, after mounting the tubular central hub 1 surrounding the corresponding shaft end 2, of a metallic band B adjusted through an appropriate tool, in such a way as to form a ring, which surrounds the tubular central hub 1 and which is pressed against the shaft end 2.

These prior art solutions present the inconveniences discussed above.

Figure 3:
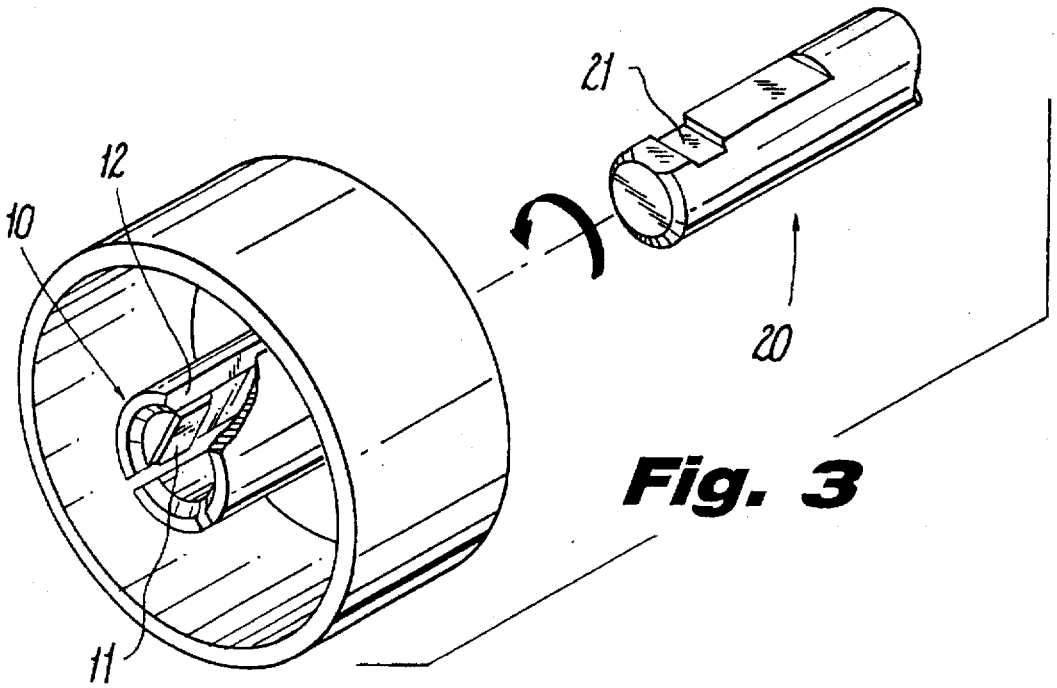
FIG. 3 shows a schematic longitudinal section view of a pair of fans mounted to the respective shaft end of a motor, according to the present invention.

FIG. 3 shows an arrangement for mounting a pair of fans to a motor, one of the fans being of the radial type while the other is of the axial type, according to a preferred construction found in air conditioners. Since the present invention is not dependent on the type of fan used, it will be described regarding a fan arrangement to be mounted to a respective motor end shaft.

Figure 4:
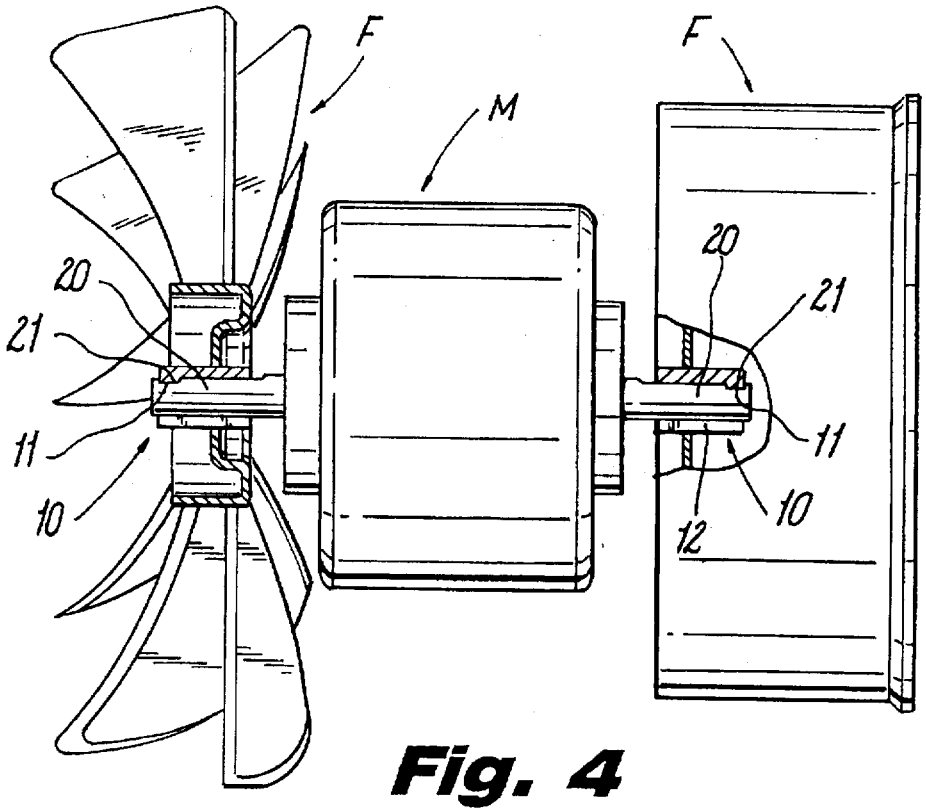
FIG. 4 shows a schematic perspective view of a fan engaging portion, onto which there are provided slots to allow the elasticity of the central hub upon being mounted to the drive shaft, according to the present invention.

According to the present invention as illustrated in FIGS. 3 and 4, the fan mounting arrangement is made by fitting a corresponding tubular central hub 10 to an adjacent shaft end 20, as described below. The central hub-shaft end assembly is obtained in the present solution by fitting at least one engaging projection 11 defined in the tubular central hub 10 to a respective engaging recess 21 preferably radial and provided in the adjacent shaft end 20.

In the preferred illustrated constructive form, the engaging projection 11 is in the form of a radial shoulder incorporated to the internal surface of the tubular central hub 10 at the beveled region thereof. The engaging recess 21 is also provided at the corresponding beveled region of the shaft end 20.

The mounting of the tubular central hub 10 to the adjacent shaft end 20 occurs by a diametral elastic deformation of the central hub 10 along part of its extension adjacent to the region where the engaging projection 11 is defined, until said engaging projection 11 fits into the corresponding engaging recess 21 provided in the adjacent shaft end 20.

In the preferred illustrated construction, the elastic deformation at the end portion of the tubular central hub 10 is achieved due to the axial slots 12 provided along part of the extension of said tubular central hub 10, preferably from a circumferential region of this length, which is internal to the region where the engaging projection 11 is provided and which extends up to the free end of said shaft end 20. The axial slots 12 may present any axial extension, provided that they permit the elastic deformation when the tubular central hub 10 is mounted to the respective shaft end 20, without impairing said tubular central hub 10.

In another possible construction, the central hub 10 is provided with an engaging element in the form of a lateral wall portion, radially projecting to the inside of said tubular central hub 10, from a curvature line defined at said lateral wall. In this construction, the tubular central hub-shaft end assembly causes an elastic deformation only in the projecting element, till it fits into said shaft end 20.

We claim:

1. A hub and shaft coupling comprising:

a hub having a tubular extension provided with axial slots along a part of the length thereof dividing said extension into separated sectional arms of resilient material having an overall inner surface of a shape conforming to the outer surface of the shaft, the interior surface of one of said hub sectional arms having a projection of a shape complementary to said shaft depressed section, said sectional arms moving radially of the shaft axis and said projection of said one sectional arm fitting into said shaft depressed section as said inner surfaces of said hub sectional arms are moved over the outer surface of the shaft, the inner surface of each said sectional arms being in full permanent contact with an opposing portion of said shaft.

2. A hub and shaft coupling as in claim 1 wherein said shaft depressed section has a flat bottom wall and said projection has a complementary shaped flat bottom wall.

3. A hub and shaft coupling as in claim 1 wherein said projection is a solid piece integrally formed with said one hub arm.

4. A hub and shaft coupling as in claim 3, wherein said shaft has a flat surface portion inwardly of said depressed section with respect to the end of said shaft and said one hub arm having the projection thereon has a complementary flat surface inwardly of said projection with respect to said arm.

5. A hub and shaft coupling as in claim 3 wherein said shaft has a flat surface portion on each side of said shaft depressed section along the length of said shaft, and the inner surface of said hub one arm having the projection thereon is flat on its inner surface on each side of said projection along the length of said one arm.

6. A hub and shaft coupling as in claim 3 wherein said shaft has a generally circular outer shape and the inner surface of each said hub sectional arm other than said one hub arm is a sector of a circle.

7. A hub and shaft coupling as in claim 4 wherein said shaft has a flat surface portion on each side of said shaft depressed section along the length of said shaft, and the inner surface of said hub one arm having the projection thereon has a flat surface on its inner surface on each side of said projection along the length of said one arm.

8. A hub and shaft coupling as in claim 5 wherein said shaft has a flat surface portion on each side of said shaft depressed section along the length of said shaft, and the inner surface of said hub one arm having the projection thereon has a flat surface on its inner surface on each side of said projection along the length of said one arm.

* * * * *